United States Patent [19]

Smith et al.

[11] Patent Number: 4,757,677

[45] Date of Patent: Jul. 19, 1988

[54] OPEN-END SPINNER PIECING METHOD AND APPARATUS AND MULTI-POSITION FRICTION SPINNER EMBODYING SAME

[75] Inventors: Alan Smith, Accrington; George K. Butler, Preston, both of England

[73] Assignee: Hollingsworth U. K. Ltd., Accrington, England

[21] Appl. No.: 921,176

[22] Filed: Oct. 20, 1986

[30] Foreign Application Priority Data

Nov. 1, 1985 [GB] United Kingdom ..... 8527002

[51] Int. Cl.[4] ..... D01H 15/02; D01H 1/135

[52] U.S. Cl. ..... 57/263; 57/261; 57/401; 57/405

[58] Field of Search ..... 57/261, 267, 405, 401

[56] References Cited

U.S. PATENT DOCUMENTS

| | | | |
|---|---|---|---|
| 4,159,616 | 7/1979 | Takeuchi et al. | 57/263 |
| 4,228,642 | 10/1980 | Dakin et al. | 57/263 |
| 4,288,975 | 9/1981 | Yoshida et al. | 57/263 |
| 4,472,933 | 9/1984 | Raasch et al. | 57/263 |
| 4,524,578 | 6/1985 | Raasch et al. | 57/263 |
| 4,538,408 | 9/1985 | Baltsch et al. | 57/263 |
| 4,563,871 | 1/1986 | Stahlecker et al. | 57/401 X |
| 4,606,184 | 8/1986 | Stahlecker et al. | 57/401 X |

FOREIGN PATENT DOCUMENTS 2109422 6/1983 United Kingdom .

*Primary Examiner*—John Petrakes
*Attorney, Agent, or Firm*—Cort Flint

[57] ABSTRACT

An open-end spinning machine includes a low inertia sensing wheel frictionally engaging the package so that the rate of rotation of the frictional sensing wheel is sensed by a tachometer generator to provide a "winding rate" signal fed to a controller for controlling the speed of a stepper motor driving the fibre feed roller of the fibre opening unit during piecing, in response to the take-up of yarn at the package. Optionally, the sensing wheel is supported on a link such that the angular position of the link indicative of the diameter of the package is sensed by an angular position transducer and the signal of the transducer is also fed to the controller.

Yarn delivery rolls are separated, during piecing, to allow the rate of withdrawal of the yarn from the doffing tube of the open-end spinning unit in response solely to the accelerating package.

The draft is non-linear during piecing, in accordance with a predetermined programme.

20 Claims, 1 Drawing Sheet

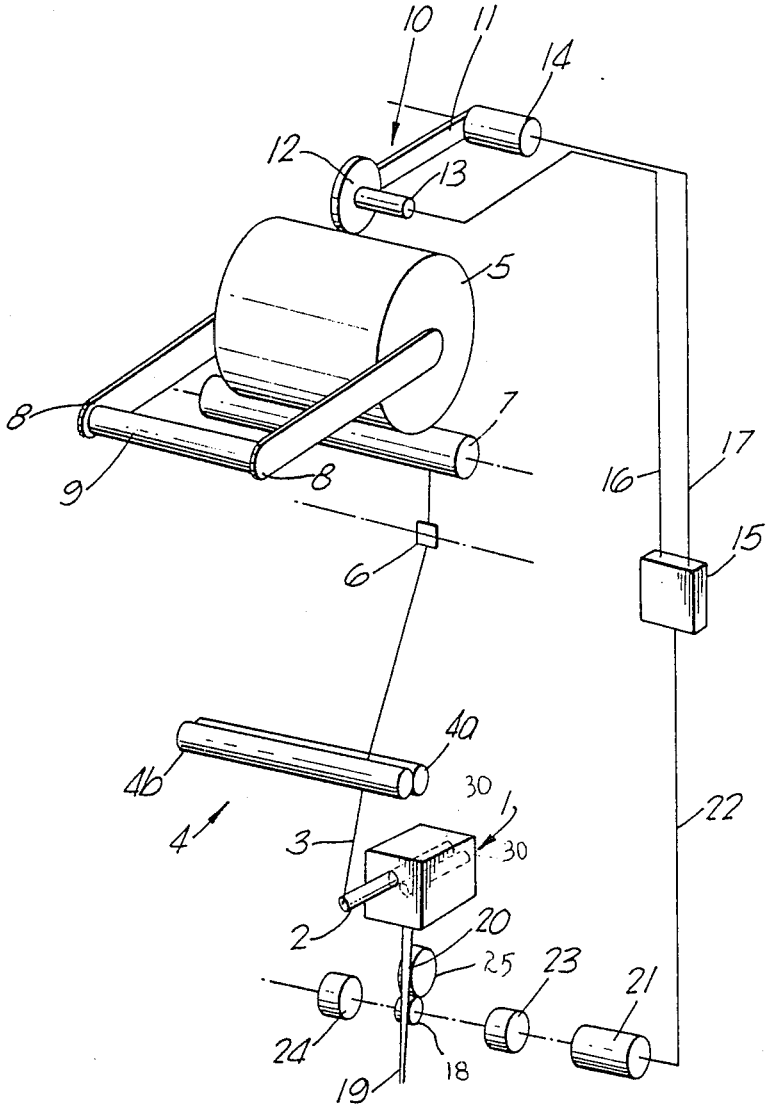
10
11
14
12
13
5
8
7
9
8
16
17
15
6
4a
4b
30
1
22
4
3
30
2
20
25
23
21
24
18
19

OPEN-END SPINNER PIECING METHOD AND APPARATUS AND MULTI-POSITION FRICTION SPINNER EMBODYING SAME

FIELD OF THE INVENTION

The present invention relates to a method of and apparatus for piecing an open-end spinner, in particular by a piecing technique which involves disengaging the conventional yarn delivery rollers during the piecing cycle and instead withdrawing the seeding yarn from the open-end spinning chamber in response to the accelerating yarn package.

PRIOR ART

In open-end spinning, either following a yarn break or following doffing of a completed package and replacement by an empty tube to receive the next-produced yarn, spinning is re-established by introducing a "seeding yarn" end of a previously spun yarn into the spinning zone where it is to receive fresh fibres to join onto that end, for example by placing it in the yarn-collecting groove of a rotor spinner or on the spinning nip of a friction spinner. Then, as fibre feed is re-established, the yarn is withdrawn and wound.

One way of piecing is to withdraw the yarn from the spinning chamber at machine speed by closing the nip between the delivery rolls at the instant of re-establishing fibre feed at machine speed, thereby achieving a rapid acceleration to normal production rate. However, this snatches the yarn from the spinning chamber and may cause a fresh yarn break, or alternatively gives rise to slackening of the yarn between the delivery nip and the yarn winder, causing the twist in the yarn to kink the yarn.

Another known piecing technique involves withdrawing the yarn from the spinning chamber in response to rotation of the winding package, in which case a rather more gentle withdrawal takes place because of the time taken for the package to accelerate from rest to machine speed. Thus this "piecing-to-package" technique involves less stresses in the yarn than with the "piecing-to-delivery nip" technique, and also there is no need for excess yarn to be temporarily stored in the winding zone as is known to be desirable where "piecing-to-delivery nip" techniques have been found to re-establish yarn delivery at a rate faster than that which the slowly accelerating package is capable of absorbing. The mis-match between the spinning rate and the winding rate is accommodated by temporarily storing yarn which subsequently is withdrawn from store and introduced into the package.

The "piecing-to-package" technique has the disadvantage that the fibre feed rate is usually matched to the rate of rotation of the rotary elements in the open-end spinning chamber, conventionally the spinning rotor in a rotor spinner or the friction rollers in a friction spinner, and because all of the spinning stations are normally driven from a common drive source it is normal for the fibre feed to resume at normal machine speed, whereas the yarn withdrawal will be initially slower during the acceleration time of the package and consequently a rather heavier yarn count is produced around the region of piecing in the yarn.

GB-A-2,109,422 discloses piecing to the delivery nip by relating the fibre feed speed to the delivery roll speed so as to achieve a constant draft of the fibrous material during its transformation from infeed sliver to spun yarn. However, this nevertheless results in variation of yarn strength and appearance at piecing.

OBJECT OF THE INVENTION

It is an object of the present invention to optimize yarn quality throughout piecing, to minimize the variation from the yarn quality achieved with stable spinning conditions at machine speed.

SUMMARY OF THE INVENTION

In accordance with one aspect of the present invention there is provided a method of piecing a friction spinning unit, comprising: introducing seed yarn from a previously wound package or a prewound package support tube into the friction spinning unit; freeing the yarn at any yarn delivery nip between the open-end spinning unit and the package winder so that the seed yarn may be withdrawn by rotation of the package; resuming spinning operation by accelerating the package or prewound package support tube and by resuming fibre feed to the spinning unit; and relating the increasing package speed to the speed of the fibre feed; wherein the relationship of the fibre feed speed to the package speed is effective to aim for a varying draft during acceleration of the package or package support tube in that the relationship of the package speed to the fibre feed speed is non-linear during at least part of the package acceleration.

The invention also provides apparatus for piecing a friction spinning unit, comprising: means for measuring the winding rate of rotation of a yarn package or prewound package support tube on which the pieced yarn is to be taken-up; a motor connected to be driven in response to the measured winding rate, for driving a fibre feed roller feeding fibre to the friction spinning unit to be pieced; and control means offering a variable draft programme to vary the ratio between the fibre feed speed and the peripheral speed of the package or prewound package support tube on which the pieced yarn is to be taken up, during at least a part of the package acceleration.

A further aspect of the present invention provides a friction spinning machine comprising: at least one spinning unit; a fibre opening unit connected to feed a supply of airborne fibres to the or a respective said spinning unit; a package winder positioned to receive spun yarn from the or a respective said friction spinning unit; means for measuring the winding rate of the package being wound by said winder; a respective motor connected to a fibre feed roller of said fibre opening unit; and a controller for driving the fibre feed roller motor at a speed responsive to the winding rate measured by the measuring unit, but non-linearly related thereto during at least a part of the package acceleration.

BRIEF DESCRIPTION OF THE DRAWING

In order that the present invention may more readily be understood the following description is given, merely by way of example, with reference to the accompanying drawing in which the sole FIGURE shows a schematic perspective view of an open-end spinning station and its winding apparatus, in accordance with the present invention.

DESCRIPTION OF THE PREFERRED EMBODIMENTS

Referring now to the drawing, there can be seen the open-end spinning unit 1 having a doffing tube 2 from which yarn 3 is withdrawn and passed, by way of a yarn delivery nip means 4 comprising a pair of delivery rolls 4*a* and 4*b*, to a yarn package 5 on which it is distributed by means of a reciprocating traverse guide 6 for the yarn.

The package 5 is driven by frictional contact with the package drive roller 7 when it is lowered into contact with the drive roller 7 by means of a cradle comprising two package support arms 8 rotatable about a common shaft 9. When doffing occurs or when a yarn break occurs, the two package arms 8 are rotated in the anti-clockwise direction by a package lifting mechanism (not shown) to interrupt drive to the package 5 which will then come to rest, preferably under the influence of a simultaneously applied brake.

A package sensing unit generally designated 10 comprises an arm 11 supporting at one end a low inertia wheel 12 operably connected to a tachometer generator 13, this low inertia wheel 12 being arranged to rest on the package during the piecing operation so that its tachometer generator 13 provides a signal indicative of the winding rate of the package.

It is possible, but not essential, to measure the angular position of the arm 11 by an optional position transducer 14 to provide a signal indicative of the angular position of the arm 11 and consequently indicative of the diameter of the package 5. The signals from the tachometer generator 13 and, if applicable, the angular position transducer 14 are fed to a controller 15 by way of lines 16 and 17.

The open-end spinning chamber is fed with a supply of airborne fibres from a fibre-opening unit comprising a fibre feed roll 18 advancing a sliver 19 to a beater roll 25 clad with pins or with toothed wire to provide a means of opening the feed sliver 19 to generate the airborne flow of separated fibres 20 for the open-end spinning operation. The rate of fibre feed is controlled by the fibre feed roller 18.

This beater roll 25 is continuously driven by the main drive of the machine but the fibre feed roll 18 can be driven, either (through a clutch 24) after piecing by the main drive of the machine or (through a clutch 23) during piecing by a stepper motor 21 which is rotated in response to signals supplied along line 22 from the controller 15. The signals in the line 22 will thus be responsive to the package winding rate signal sensed by the tachometer generator 13 and possibly also to the package diameter signal sensed by the angular position transducer 14, if present.

In order to describe the present invention in more detail, one piecing cycle will now be explained.

Prior to the piecing command the stepper motor 21 is switched on and will assume an appropriate speed for initial fibre feed. The initial fibre feed speed may, for example be responsive to the package diameter signal in line 17. However because the two clutches 23 and 24 are disengaged the fibre feed roller 18 is at rest.

When the "piecing" command is given, for example by operation of a manual piecing lever, two switches are operated at a timed interval. One switch energizes the clutch 23 to drive the fibre feed roller 18 from the stepper motor 21 and the other switch cancels the package lift mechanism allowing the package support arms 8 to pivot clockwise to drop the package 5 onto the friction drive roller 7.

When the clutch 23 is engaged the fibre feed roller 18 begins rotation at a speed which is some proportion of machine speed.

As indicated above, the initial fibre speed may be affected by the package diameter signal from the optional angular position transducer 14. A large diameter package will be expected to take longer to accelerate, and will therefore require a lower initial fibre feed from the stepper motor 21, whereas a small diameter package can be expected to accelerate more rapidly and require a much higher initial fibre feed speed.

As soon as the package 5 contacts the friction drive roller 7 which is already rotating at machine speed, the package 5 will accelerate, with some slip through the frictional engagement between the package 5 and the drive roller 7, and the actual rate of rotation of the package 5 will be monitored by the low inertia friction wheel 12 now resting on it and driving the tachometer generator 13 to pass a signal along the line 16 to the controller 15. Hence, during acceleration of the package, the rate of rotation of the stepper motor 21 will itself increase until, when the package 5 reaches machine speed, so also will the fibre feed roller 18.

At this stage the piecing operation will have been completed in that yarn 3 will be running at machine speed between the spinning location within the spinning unit 1 and the periphery of the package 5, and it is then possible for the clutch 24 to be engaged and for the clutch 23 to be simultaneously or subsequently disengaged to leave the fibre feed roller driven by the main drive of the open-end spinning machine, whereupon the stepper motor 21 can be de-energized, after a suitable brief time delay to ensure a smooth transfer of drive from the stepper motor to the main drive.

At the same time as the disengagement of clutch 23, the yarn delivery nip means 4, whose driven roll will already be rotating at machine speed, is closed to provide a constant velocity yarn take-up which will be independent of any speed variations resulting from the position of the yarn in its fan upstream of the traversing guide 6.

The triggering of the signal to disengage the clutch 23 and to close together the yarn delivery nip means 4 is generated in response to attainment of a nominal machine speed value for the peripheral speed of the package 5. This may be detected by means of the tachometer generator 13 or by any other means.

For example, it is possible to calculate the expected peripheral speed of the package 5 for any diameter, and to calculate a specific rotation rate of the low inertia wheel 12 for any given position signal from the transducer 14 to define a target machine speed the attainment of which results in engagement of the clutch 24, disengagement of the clutch 23, and closing of the yarn delivery nip means 4.

Where a package diameter transducer 14 is provided, the precise relationship between the stepper motor speed, before engagement of the clutch 23, and the package diameter may have been determined by experiment in order to give the desired uniformity of the yarn quality throughout the piecing operation.

Uniformity of yarn quality may require a substantially constant yarn count to give the yarn the least possible change in appearance at the location of piecing, or uniformity of tensile strength at the piecing, so that the tensile strength at the location of piecing is equal to the tensile strength elsewhere along its length, or a compromise of optimization of both of these parameters, or uniformity of some other property of the yarn.

During piecing, the draft of the open-end spinner is controlled so as to be non-linear for at least part of the package acceleration, but to maintain uniformity of yarn quality.

In normal steady state conditions, the draft, i.e. the ratio of the linear speed of the product spun yarn to the linear speed of the incoming sliver is constant.

With the preferred embodiment of the present invention the open-end spinner is a friction spinner in which the friction spinning rollers, which may be parallel cylindrical rollers as shown in broken lines at 30, or inclined axis conical rollers, or skew axis hyperboloidal rollers, are maintained rotating at machine speed and, when piecing is desired, the seed yarn is introduced into the nip to begin rotation of the yarn.

In the early stages of delivery of the seed yarn and the stream of twisting fibres joined thereto to form the start of the product spun yarn, the linear speed of the withdrawn yarn is less than machine speed whereas the rate of rotation of the friction surfaces of rollers 30 is equal to machine speed, resulting in an overtwisting of the yarn at the location of piecing. Furthermore, because the fibre feed is expected to achieve machine speed more rapidly than the withdrawal of the yarn, if no special precautions had been taken, as in the present invention, to maintain a known relationship between the sliver feed rate and the yarn winding rate, there would be a localized thickening of the yarn until the sliver feed rate and the yarn withdrawal rate are stabilized at machine speed values.

By appropriately programming the controller 15 to effect a variable draft programme while optimising yarn quality, it is possible to mitigate the effects of these expected irregularities.

One possibility is for the controller 15 to be capable of accepting manually input programme characteristics so that the operator can vary the programme in accordance with parameters such as yarn count and fibre type, and package diameter, but alternatively the more sophisticated result could provide several different preset programmes with means for selecting a particular programme appropriate to the yarn count and/or fibre type, and with further programme selection on the basis of the automatically measured package diameter achieved by the diameter transducer 14.

Furthermore, although the preferred embodiment of the present invention uses constantly rotating friction spinning rollers 30 with the yarn introduced into the nip at the instant of piecing, the invention also embraces the possibility of slowing down the friction spinning rollers 30 and initially accelerating the package, and the fibre feed, to a speed which is matched to the reduced friction spinning roller speed, and then accelerating all of these components together to machine speed. In that case, the variable draft conditions will be expected to apply only during the initial part of the package acceleration, until such time as the fibre feed and the package speed are matched to the reduced roller rotation speed.

In effect, the piecing method in accordance with the present invention spreads the inevitable mis-matching of draft over an extended length of the seed yarn, thereby optimizing yarn quality in terms of both yarn tensile strength and appearance, whereas conventionally it has been felt that constant draft conditions should be attained as soon as possible, if not from the outset, in which case there would be a more pronounced variation of at least yarn appearance at the location of piecing since the piecing then occurs at a point rather than over a region of the product yarn as in accordance with the present invention.

If desired the stepper motor may be carried by a piecer robot and may become releasably engaged with the drive to the fibre feed roller of each spinning unit to be pieced. The package speed sensor may also form part of such a robot.

The relationship between the package speed and the fibre feed may depend upon several variables. For example where the fibre prefeed is slaved to the package speed the fibre prefeed may be greater for higher drafts than for lower ones, and the fibre prefeed may be higher for a lower delivery speed than for a higher one. Also, the fibre prefeed may depend on the nature of the staple fibre material being spun. The relationship between these parameters need not, however, be linear.

As an alternative to slaving the fibre feed speed to the speed of the accelerating package, it is possible to slave the package speed to increasing fibre feed speed, or to slave both the fibre feed speed and the package speed to a reference signal varying with time during the piecing operation.

We claim:

1. A method of piecing a friction spinning unit having a main machine drive and fibre feed means and to which fibre is delivered by a fibre feed, comprising the steps of:

(a) introducing seed yarn from a yarn package or a prewound package support tube supported for rotation on a package winder into the friction spinning unit;

(b) freeing the yarn at a yarn delivery nip between the friction spinning unit and the package winder so that the seed yarn may be withdrawn by rotation of the yarn package;

(c) accelerating rotation the yarn package or prewound package support tube and initiating fibre feed to the friction spinning unit; and (d) relating the increasing yarn package speed to the speed of the fibre feed means such that the relationship of the fibre feed means to the yarn package speed is effective to provide for a varying draft during acceleration of the yarn package, in that the relationship of the yarn package speed to the speed of the fibre feed means is non-linear during at least a part of the yarn package acceleration.

2. A method according to claim 1, wherein step (d) comprises varying the draft in such a manner as to optimize the appearance of the spun yarn at the location of the piecing.

3. A method according to claim 1, wherein step (d) comprises varying the draft in a manner so as to achieve a tensile strength of the yarn at the location of piecing which is substantially equal to the yarn tensile strength to either side thereof.

4. A method according to claim 1, wherein step (d) comprises varying the draft to achieve a compromise between optimization of the appearance of the spun yarn at the location of piecing and maximum tensile strength of the spun yarn at the location of piercing.

5. A method according to claim 1, wherein step (c) comprises allowing the yarn package to accelerate freely and wherein step (d) includes controlling the speed of the fibre feed means in relation to the acceleration of the yarn package to give the required draft programme.

6. A method according to claim 1, wherein the spinning unit includes friction spinning rollers and the package winder includes a frictional drive roller, said friction spinning rollers and drive roller are rotating at normal machine speed during piecing; and wherein the seed yarn is first of all held clear of the friction spinning rollers but at the instant of piecing, the seed yarn is allowed to contact the friction spinning rollers to begin rotation of the seed yarn.

7. A method according to claim 1, wherein the spinning unit includes friction spinning rollers and the package winder speed and the rate of rotation of the friction spinning rollers are below normal machine speed at the instant of piecing.

8. A method according to claim 1, wherein control of the draft is effected in accordance with any one of several different variable draft programmes which may be selected dependent on yarn types and count.

9. A method according to claim 8, wherein the draft varying programme is changed according to the diameter of the yarn package or prewound package support tube at the instant of piecing.

10. A method according to claim 1, wherein control of the variable draft is effected by means of a controller having as one input signal the rate of rotation of a low inertia sensor wheel riding on the yarn package or prewound package support tube being accelerated.

11. A method according to claim 1, including controlling the fibre feed means by a stepper motor during piecing in accordance with a predetermined variable draft programme; and including taking over the driving of the fibre feed means by the main machine drive and rendering said stepper motor ineffective once the fibre feed means has attained normal machine speed.

12. A method according to claim 11, including the step of closing the delivery nip onto the running yarn with delivery rolls already rotating at normal machine speed, upon attainment of normal machine speed by the yarn package or prewound package support tube and the fibre feed means.

13. Apparatus for piecing a friction spinning unit, comprising:

(a) a package support;
(b) means for winding yarn onto said package support to form a yarn package thereon;
(c) measuring means for measuring the rate of rotation of said yarn package during winding of the pieced yarn being taken-up thereon;
(d) a fibre feed roller for feeding fibre to the friction spinning unit to be pieced;
(e) a motor connected to be driven in response to the measured winding rate, for driving said fibre feed roller; and
(f) draft control means offering a variable draft programme to vary the ratio between the speed of the fibre feed roller and the peripheral speed of the yarn package or a prewound package support tube on which the pieced yarn is to be taken up, during at least a part of the yarn package acceleration.

14. Piecing apparatus according to claim 13, including clutch means effective to engage and disengage the driving connection between said motor and the fibre feed roller.

15. Piecing apparatus according to claim 13, wherein the draft control means includes a control programmer offering several different variable draft control programmes.

16. Piecing apparatus according to claim 15, including means for measuring the diameter of the yarn package being wound on the package support by the yarn winding means prior to take-up of the pieced yarn on said yarn package, and for selecting a suitable one of said variable draft programmes consistent with the measured diameter value.

17. Piecing apparatus according to claim 13, wherein said friction spinning unit includes friction spinning rollers and said controller is effective to maintain the friction spinning rollers and the package winder running at least than their normal machine speed during piecing.

18. A friction spinning machine comprising:

(a) at least one spinning unit;
(b) a fibre opening unit connected to feed a supply of airborne fibres to said at least one spinning unit;
(c) a feed roller for feeding fibre to said fibre-opening unit;
(d) a package winder positioned to receive spun yarn from the said friction spinning unit;
(e) measuring means for measuring the winding rate of the yarn package being wound by said package winder;
(f) a motor connected to drive said fibre opening unit feed roller; and
(g) a controller for driving the fibre opening unit feed roller motor at a speed responsive to the winding rate measured by the measuring means, but non-linearly related thereto during at least a part of the acceleration of a yarn package being wound by said package winder.

19. A friction spinning machine according to claim 18, including a plurality of said spinning units, each having a respective package drive roll to drive each package winder, and common drive means for the package drive rolls of the package winders of the various spinning units; and means for initiating drive to accelerate a yarn package of each package winder by moving the yarn package into contact with its package drive roll; wherein said driving contact is established while the yarn package is still in engagement with the measuring means for sensing the rate of rotation of the accelerating yarn package or package support tube, and wherein the package drive rolls all rotate at constant machine speed during the piecing process on any one spinning unit.

20. Apparatus according to claim 18, including means for measuring the diameter of the yarn package or package support tube at each winder, and wherein said controller for driving the fibre opening unit feed roller motor includes a programmable controller having a plurality of different variable draft control programmes, said programmable controller being responsive to said diameter measuring means for varying the variable draft control programme of that friction spinning unit in dependence upon the measured diameter value.

* * * * *